US008707626B2

(12) United States Patent
Martin

(10) Patent No.: US 8,707,626 B2
(45) Date of Patent: Apr. 29, 2014

(54) MAGNETIC SYSTEM FOR SUPPORTING A SLIDING CLOSURE

(76) Inventor: Matthew H. Martin, Lomita, CA (US)

( * ) Notice: Subject to any disclaimer, the term of this patent is extended or adjusted under 35 U.S.C. 154(b) by 0 days.

(21) Appl. No.: 13/584,510

(22) Filed: Aug. 13, 2012

(65) Prior Publication Data

US 2014/0041304 A1 Feb. 13, 2014

(51) Int. Cl.
*E05D 15/06* (2006.01)

(52) U.S. Cl.
USPC ..... 49/409; 49/404; 49/411

(58) Field of Classification Search
USPC ..... 49/409, 410, 411, 404, 316, 320, 321
See application file for complete search history.

(56) References Cited

U.S. PATENT DOCUMENTS 1,226,548 A * 5/1917 McIntosh ..... 16/99
1,489,018 A * 4/1924 Shultz ..... 49/174
3,334,442 A * 8/1967 Boettcher ..... 49/231
3,346,993 A 10/1967 Johnson
3,416,260 A * 12/1968 Johnson ..... 49/404
3,442,051 A * 5/1969 Johnson et al. ..... 49/414
4,090,265 A * 5/1978 Baus ..... 4/607
4,876,765 A 10/1989 Karita
5,134,324 A * 7/1992 Sakagami et al. ..... 310/12.04
5,712,516 A 1/1998 Kabout
5,736,693 A * 4/1998 Piech et al. ..... 187/316
5,964,060 A * 10/1999 Furlong ..... 49/320
7,013,605 B2 * 3/2006 Zhou et al. ..... 52/30
7,752,810 B2 * 7/2010 Haab et al. ..... 49/409
8,020,346 B2 9/2011 Singiser et al.
8,033,068 B2 * 10/2011 Luttmann et al. ..... 52/243.1
8,109,040 B2 * 2/2012 Finke ..... 49/360
8,381,444 B1 * 2/2013 McDonald et al. ..... 49/213
2003/0110696 A1 * 6/2003 Rennetaud et al. ..... 49/120
2006/0150518 A1 7/2006 Va 't Zelfde et al.
2008/0100152 A1 5/2008 Busch

* cited by examiner

*Primary Examiner* — Gregory J Strimbu
(74) *Attorney, Agent, or Firm* — Fulwider Patton LLP

(57) ABSTRACT

A system for reducing an effective weight of a horizontally sliding object, wherein the object such as a door or window is retained in a track that allows substantially horizontal movement along a predetermined path. The door has an upper surface with a longitudinal cavity therealong, a metallic channel is disposed within the longitudinal cavity, and the channel receives a plurality of permanent magnets. The system also includes an elongate strip coinciding with the predetermined path and positioned adjacent the upper surface of the door. An adjustment mechanism is also provided for releasably adjusting the distance between the magnets and the elongate strip.

2 Claims, 5 Drawing Sheets

MAGNETIC SYSTEM FOR SUPPORTING A SLIDING CLOSURE

BACKGROUND

The present invention is directed to a system for facilitating the manual or mechanical translation of an object, such as for example a sliding door, window, or suspended object moving horizontally along a track, using magnets to reduce the weight of the object and therefore reduce the force needed to transfer the object from one location to another.

Systems for moving objects such as doors and windows using magnets are known in the art. Some of the various strategies for employing magnets to reduce weight are discussed below.

U.S. Patent Publication No. 2006/0150518 to Van't elfde et al.

Van't elfde et al. discloses a sliding panel for use in an architectural opening that is connected either at its top edge or bottom edge to a carrier that supports the panel with magnetic system that includes a magnet and a ferrous member. The magnet is positioned on either the carrier or the panel and the ferrous member is on the other carrier or the panel with the magnet attracting the ferrous member to connect the panel to the carrier.

U.S. Patent Publication No. 2008/0100152 to Busch

Busch discloses a magnetic drive system for driving a door leaf in a driving direction. The drive system includes a row of magnets disposed in the driving direction and having a longitudinal direction, the magnets being arranged so that magnetizations of the magnets reverse in accordance with a predetermined pattern; and a coil arrangement comprising a plurality of coil cores and a plurality of coils, the coils being wound around respective coil cores and spaced apart from each other in the longitudinal direction of the row of magnets. When energized, the magnetic coils interact with the magnets to generate a thrust force for driving the door leaf in the driving direction.

U.S. Pat. No. 3,346,993 to Johnson

Johnson discloses panels, windows, doors or the like that are slidably positioned in a vertical plane for movement only in such vertical plane. The door or other article is supported by means of pairs of elongated permanent magnet attached to the door and to an associated frame means whereby the magnets, extending at least substantially the width of the door and frame and support or float the door for lateral movement.

U.S. Pat. No. 4,876,765 to Karita

Karita discloses a door that uses magnets to suspend the door as it transitions between a closed position and an open position, and a support device for supporting the door. The support device includes a magnet mounted on one of the door and the stationary structure, and a member of a magnetic material mounted on the other of the door and the stationary structure. The magnet and said magnetic member cooperate with each other to produce a magnetic force therebetween to support at least part of the weight of the door.

U.S. Pat. No. 5,712,516 to Kabout

Kabout describes a sliding door consisting of a door panel, a series of permanent magnets arranged on the top edge of the panel and a guide strip of magnet-sensitive material arranged on the upper side of the door recess. This allows the door panel to be suspended from the recess by means of the magnetic action and is slidably reciprocal along the strip.

U.S. Pat. No. 8,020,346 to Singiser et al.

Singiser et al. discloses a sliding door or window supporting system which has a stationary frame with a bottom track and a sliding portion that slides from a closed position to an open position. The bottom portion of the sliding portion and the upper surface of stationary frame track are provided with one or more magnets having identical magnetic polarity, thereby creating repulsion between the bottom of the sliding portions and the stationary track. The opposing magnetic forces support the sliding door and purportedly allow for a smooth, easy sliding action due to the reduction in the weight of the door.

Japanese Patent No. JP403194084 to Tabuchi

Tabuchi discloses two guide rollers that are rotatably supported to a suspension metal mounted to an upper end of a sliding door and an auxiliary rail installed therebetween. A rare earth magnet is secured to an upper piece of the suspension metal and the weight of the sliding door is supported by means of a powerful attraction force between a rail and the magnet.

Korean Patent No. 2008077871 to Geun

Geun discloses a door supported by a door frame and a door floating unit installed at a top/bottom surface of the door and at a top/bottom surface of the door frame. A magnet is installed at an upper frame or lower frame and also on the door. A driving unit is installed at the upper frame and top of the door. An electro-magnet or fixed magnet is mounted at the top of the door. A drive wheel faces the electro-magnet and provided with poles on an outer surface. A motor drives the drive wheel.

While each of these systems utilize magnets to aid in sliding a door from one location to the other, each system suffers one of several drawbacks including undue complexity, cost, and reliability. The present invention, on the other hand, is a cost effective, commercially feasible system that can be applied to many applications beyond the door and window utilization.

SUMMARY OF THE INVENTION

The present invention is a system for moving objects that uses magnets, preferably permanent magnets, to reduce the weight of the object, substantially levitating the object, and thereby making it much easier to move. For example, when applied to a patio door weighing in excess of 80 pounds, the present invention can reduce the operating weight of the door to approximately 2 pounds or less. In a first preferred embodiment of the present invention, the magnets are secured to the top of the door or window using a channel formed in the upper surface, which cooperates with a steel or other ferromagnetic material that is proximally incorporated into the top of the door frame or track. The magnetic attraction between the magnets and the ferromagnetic track transfers the weight of the door or window to the door frame via the ferromagnetic track, thereby reducing the overall operating weight of the door or window. A spring loaded adjustment mechanism is preferably provided that adjusts the spatial offset between the magnets and the track, allowing easy installation and removal of the door or window from its frame while permitting control over the magnetic interaction between the door and frame.

Testing of the present invention has shown that the amount of force needed to move typical doors is reduced by an average of 76.4% and as much as 90%. This reduction in weight also leads to a reduced weight on the door's supporting wheels and track, which in turn results in an extended life of the door components such as wheels, rollers, and the like. Track warping is a major contributor to the need for replacement of existing doors in a building. The present invention extends the life of new or existing doors and windows as a result of lower stress and mechanical force applied to the critical support elements. Moreover, permanent magnets lose strength on the order of only one percentage point every ten years, meaning the system once incorporated into a building or structure may last the duration of the lifetime of the building. The present invention is also inexpensive to mass produce.

Another advantage of the present invention is related to the accumulation of dirt and debris in the track of sliding windows/doors. This debris is one of the most common causes that sliding doors become more difficult to move over time, and lead to increased maintenance costs. However, when the present invention is employed, the effect of this dirt and debris accumulation on the track is minimized due to the reduction of weight on the wheels or other supports. The detrimental effect of rusting of the wheels and bearings is also reduced. Furthermore, when maintenance is required on doors and windows using the present invention, costs are reduced because large doors or windows that normally take two people to repair or provide maintenance can be replaced with a single repair person. That is, the present invention by virtue of the magnetic attraction facilitates easier installation and removal of large sliding doors with less effort and time.

The present invention also reduces costs by reducing heat loss through the door. Traditionally, the air gap between the frame and door and frame can be as large as one and a half inches on some patio doors due to the aforementioned accumulation of dirt and debris, and thus money is wasted on heating and cooling costs over long periods of time. The present invention reduces this gap to fractions of an inch while still allowing installation/removal of the door/window.

DETAILED DESCRIPTION OF THE PREFERRED EMBODIMENTS

Figure 1:
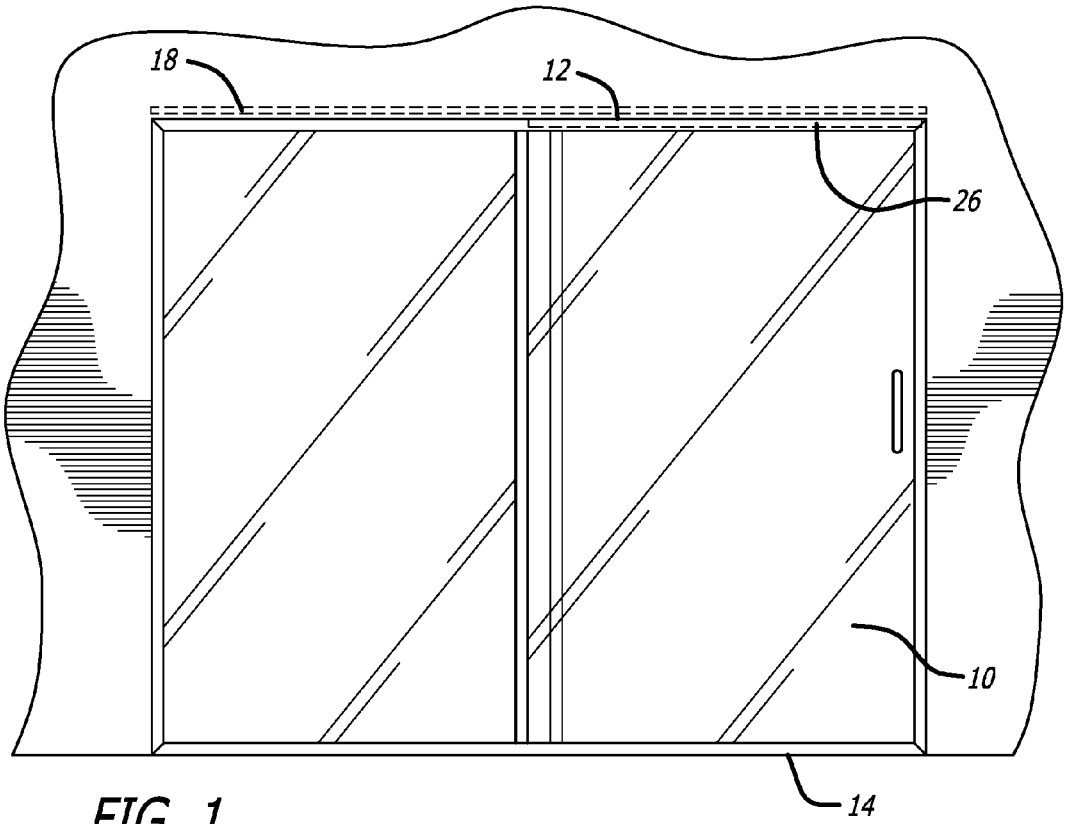
FIG. 1 is a front view of a sliding glass door incorporating a first embodiment of the present invention.
Figure 2:
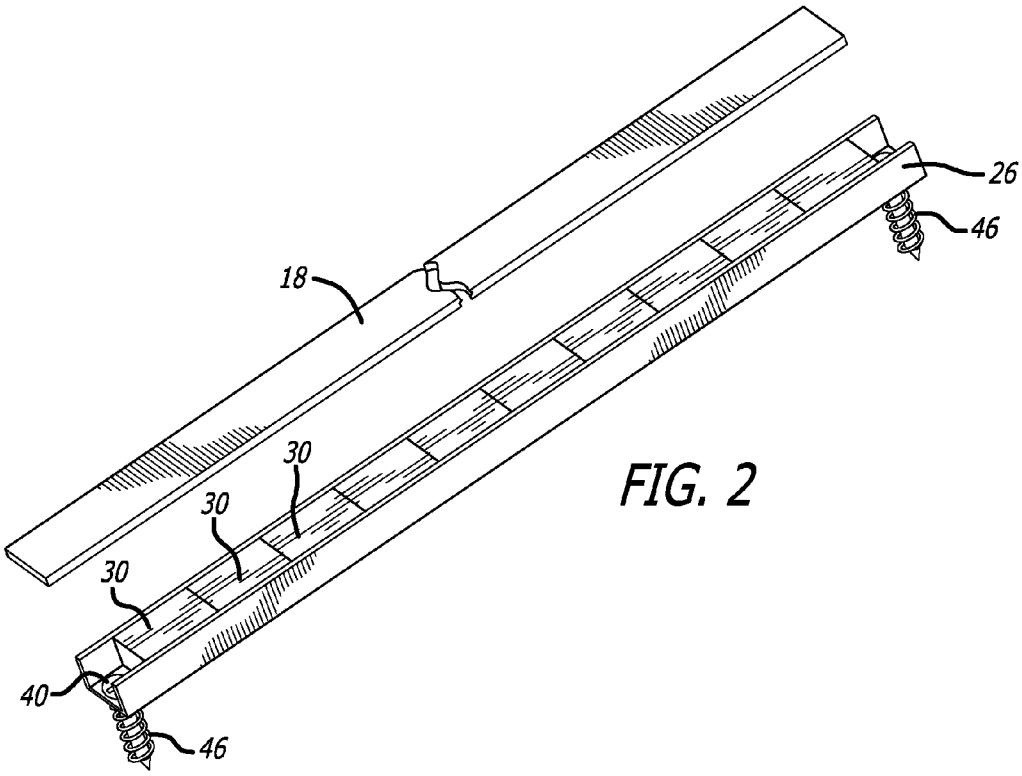
FIG. 2 is an enlarged, elevated perspective view of a first embodiment of the present invention.

FIG. 1 illustrates an example of a type of environment for the present invention, such as a large sliding glass door 10. The invention is not limited to this environment, but rather many other applications will become readily identifiable that can use the benefits of the present invention. The door can be fitted so as to be captured between an upper track 12 and a lower track 14. The door 10 slides along its designated path between the two tracks, supported by wheels (not shown) or other friction reducing devices. FIG. 2 illustrates the magnetic system of the present invention, which includes two main components. The first component is a strip 18 of ferromagnetic material, such as for example steel, which is mounted to the upper track 12 adjacent the upper surface 20 of the door 10. The strip 18 is adequately secured to a load bearing surface such as a door frame so that it can transfer the weight of the door or suspended object to the door frame via magnetic attraction. The strip 18 is preferably continuous and extends the length of the track 12, although it can be segmented if necessary into a plurality of smaller strips spaced apart from each other. However, the ferromagnetic strip 18 will typically be the least expensive component of the system and therefore it will usually be more cost efficient to extend the strip across the entire path of the door 10.

Figure 3A:
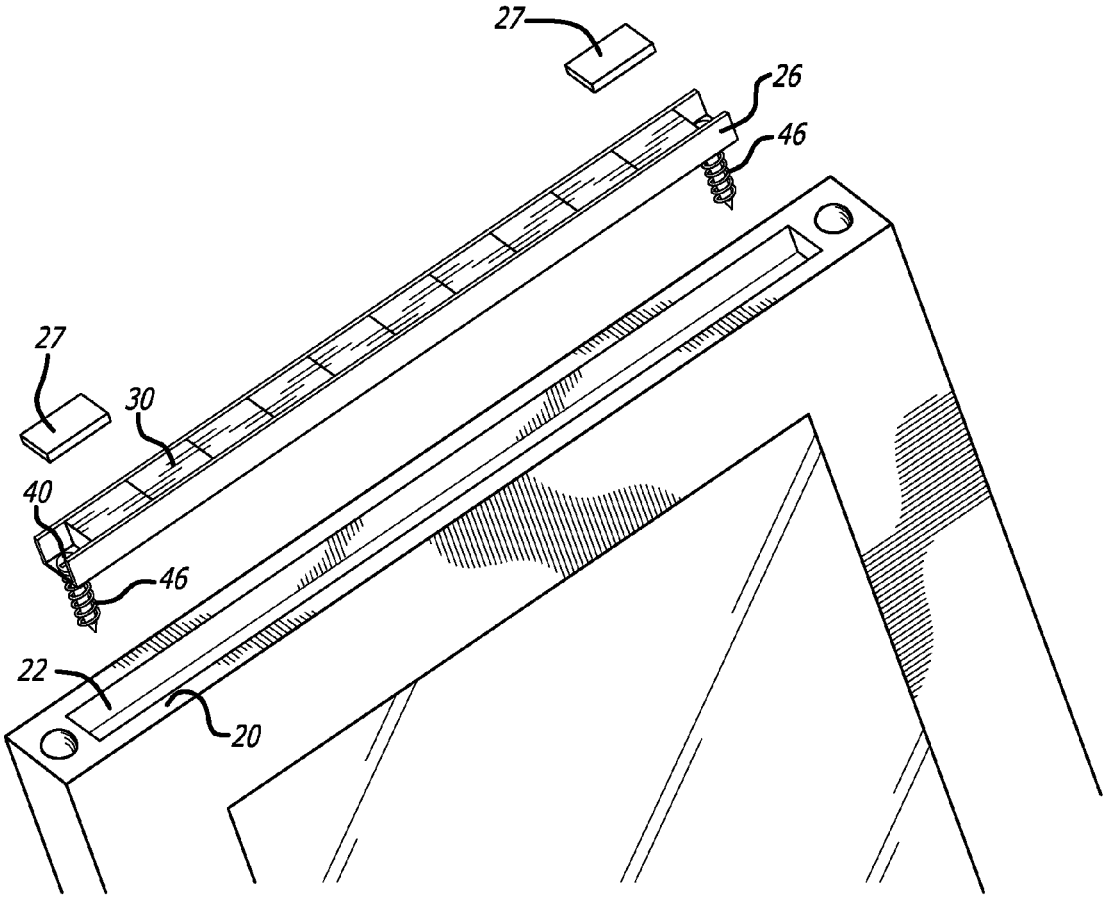
FIG. 3*a* is an elevated perspective view of the system of the present invention being incorporated into an upper surface of a sliding object.
Figure 3B:
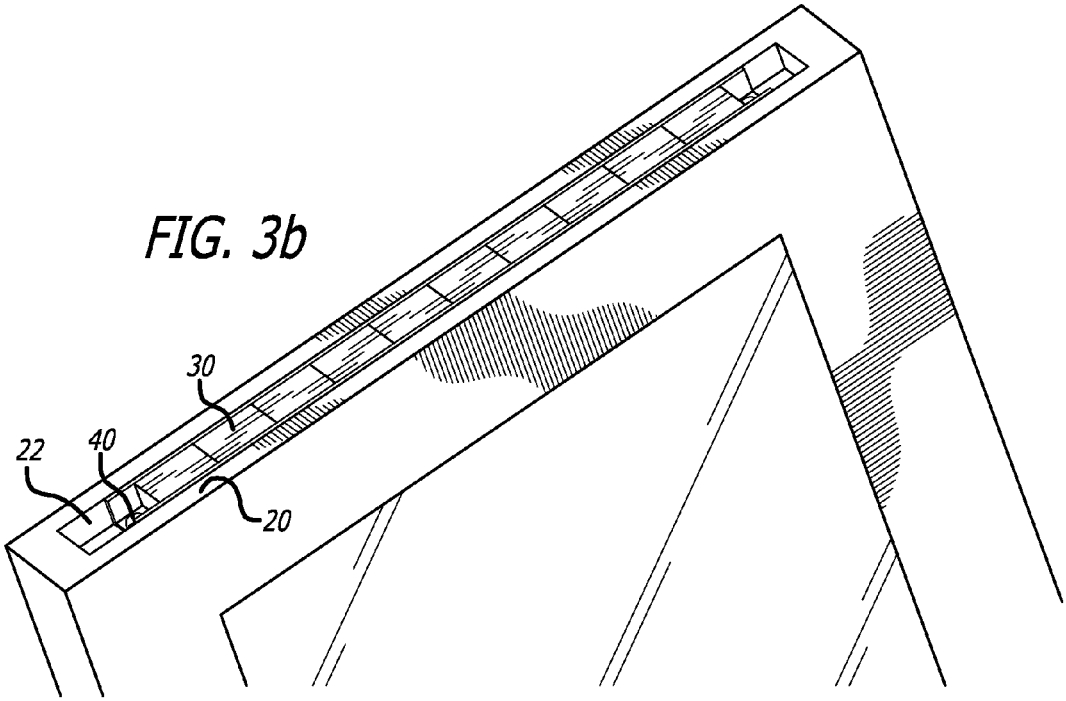
FIG. 3*b* is an elevated perspective view of the system of the present invention after being incorporated into the sliding object.
Figure 4:
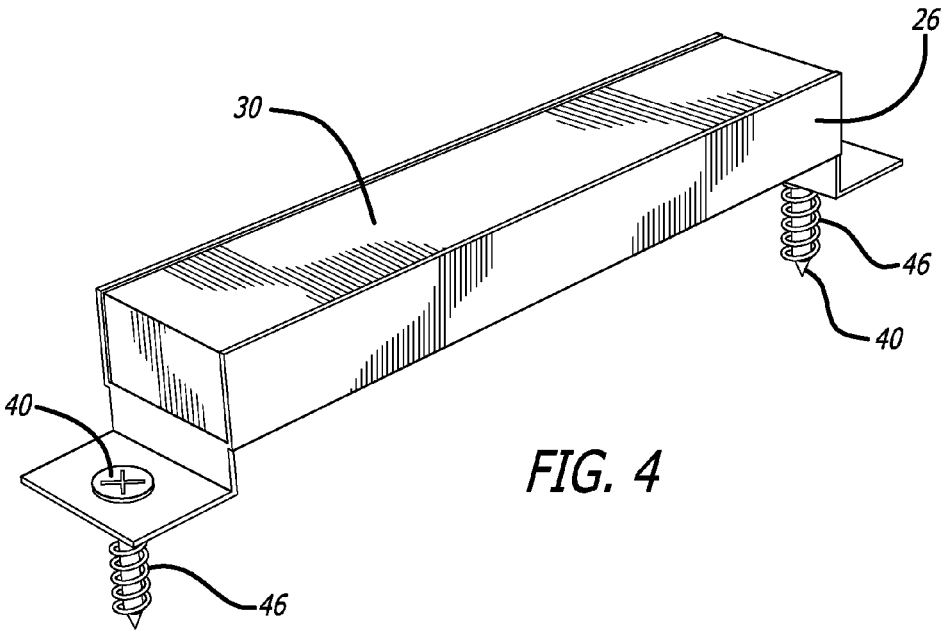
FIG. 4 is an elevated perspective view of the adjustment mechanism.

The second component of the system of the present invention is a structure such as a C-shaped channel 26 having opposed side surfaces and a bottom surface with an open top. This structure can be modified and the invention is not so limited, but rather other structures can be substituted and fall within the spirit of the invention. A cavity 22 is formed into the upper surface 20 of the door 10 (see FIGS. 3*a*, 3*b*), and the C-shaped channel 26 is fitted into the cavity 22 so as to be substantially recessed with the upper surface 20 of the door 10. Inside the C-shaped channel 26 are disposed a plurality of permanent magnets 30 that maintain an attractive force with the strip 18 on the frame's upper track 12.

This C-shaped channel 26 includes a hole at each end that retains a fastener 40. The fastener 40 is used to secure the C-shaped channel 26 to the upper surface of the door 10 inside the cavity 22. The fastener 40 is positioned through a coil spring 46 with sufficient capability to biases the C-shaped channel 26 away from the upper surface 20 of the door 10. Note that other springs may be used to position the C-shaped channels, such as leaf springs between the C-shaped channel and the bottom of the cavity 22. Other biasing means are also considered within the scope of the present invention. Also, adjustment can be further refined by the inclusion of spacers 27 above the magnets to adjust the distance between the magnets 30 and the magnetic strip 18 and also cushion the magnets from scratching in case of direct contact with the magnetic strip 18. By adjusting the distance traveled by the fastener 40 into the door 10, the position of the C-shaped channel 26 and thus the magnets 30 relative to the ferromagnetic strip 18 on the upper track 12 can be adjusted and fine-tuned. The fasteners 40 therefor can adjust the lifting force of the system, providing greater lifting as the C-shaped channel 26 is positioned closer to the track 18 and less lifting force as the C-shaped channel 26 is positioned farther from the track. The adjustment mechanism, comprising the fastener/spring combination, also facilitates the easy ingress and egress of the door 10 into its door frame.

When the door 10 is lifted up off of its bottom track, if a portion of the C-shaped channel 26 is outside of the plane of the upper surface 20 of the door, it compresses the springs 46 (or other comparable springs) and moves the C-shaped channel 26 into the cavity 22 along the upper surface 20 of the door 10, so that the door 10 can be easily removed from its frame. This feature maximizes the effectiveness of the lifting force of the permanent magnets, which are the most costly components of the mechanism. It is well established that the strength of a magnetic field is related to the distance apart between the magnet and the attracted object. This means that the small changes in the gap, e.g. 1/16", equates to a potentially large change in the lifting force. Since the magnets 30 are the most costly part of the system, the capacity to adjust and maximize this component reduces the manufacturing costs of the invention and makes it more economical to manufacture and use. Affixing the magnets 30 to a steel strip or inside a steel C-channel also helps maximize the lifting force or strength of the assembly because the C-channel focuses the magnetic field and thus strengthens the magnets' effect. A C-shaped channel also helps to minimize the deflection that occurs from the significant forces exerted on the magnetic strip.

In a preferred embodiment, the ideal lifting force is approximately slightly less than the weight of the object to be moved. That is, testing has shown that it's best to engineer an amount of lifting force that doesn't lift the entire weight of the door 10 when the two components 18, 30 come into contact. For example, if a sliding patio door weighs 55 pounds, then the amount of lifting force of the magnets 30 should total less than that when the two components come in contact. Rather, a total lifting force of 53 pounds is preferred since this prevents the magnetically suspended object from "locking up" and being lifted uncontrollably. On experimental doors, the amount of lift has been calibrated to around 90% of the door's weight so that 10% of the effective weight is left on the wheels and track. With a finely designed, constructed, and mass produced assembly, 95% or more of the weight could likely be suspended.

Example 1

The average sliding pressure of five different sliding doors of differing weights were tested before the present invention was installed, and then again after. The average required sliding pressure before and after for each prototype was compiled from five tests using a spring scale calibrated in grams.

| # | Application | Approximate Weight | Avg. Beginning Sliding pressure (grams) | Avg. Sliding Pressure after MTSM (grams) | Percent Change in Sliding Pressure |
|---|---|---|---|---|---|
| 1 | Patio Door | 55 lbs | 2250 | 610 | −72.9% |
| 2 | Patio Door | 45 lbs | 2200 | 450 | −79.5% |
| 3 | Mirrored Closet Doors | 50 lbs | 2500 | 250 | −90.0% |
| 4 | Wooden Closet Doors | 25 lbs | 1250 | 400 | −68.0% |
| 5 | Screen Door | 7 lbs | 700 | 200 | −71.4% |
| | | | | Avg. Reduction in Sliding Pressure | −76.4% |

The average percent reduction in required sliding force was calculated to be 76.4%. The highest reduction in sliding force was door number 3 which had a 90% average reduction in required sliding force. The lowest average percent change in required sliding force was door number 4 at 68%. The results of this test show that the present invention substantially reduces the required sliding force of modified doors. The 90% reduction in the required sliding pressure of the mirrored closet doors shows that well-built and calibrated system of the present invention can achieve even a higher average reduction in sliding pressure.

The configuration of the present invention makes magnetically suspended doors and windows more economically feasible than any of the prior art. This is accomplished by maximizing the lifting the strength of the permanent magnets which are the most costly components of the invention. By utilizing permanent magnetic attraction, as opposed to repulsion, to a ferromagnetic track; permanent magnets are only required to be used on whatever object is being moved (patio door, window, closet door, screen door, pocket door, shower door, room divider, aircraft hangar door, etc.). Using magnetic repulsion to suspend a door or window is at least three times as expensive because it requires a continuous row of permanent magnets that spans the length of the entire door/window opening. A strip of steel spanning 10 feet is much cheaper than permanent magnets spanning 10 feet.

No wheels are required to provide spacing between the stator and the rotor in the present invention. By incorporating more or fewer permanent magnets, the amount of lifting force can be controlled so that it does not exceed the entire weight of rotor. This means there is no need for spacing wheels which add to the cost of the invention. Thin facings, such as tape or plastic strips, can be added to the top of the permanent magnets to reduce lifting strength if needed. This can also be accomplished with small bumpers that only prevent the rotor from being wholly lifted to the stator.

The ferromagnetic c-channel which encloses the permanent magnets serves two purposes. First, to focus and increase the strength of the permanent magnets in the vertical direction. Second, to minimize the amount of structural deflection that occurs from the lifting forces incurred. The unique spring-loaded adjustment feature of the invention also serves multiple purposes. First, it allows for adjustment and maximizing of the lifting strength of the permanent magnets by permitting precise adjustment of the gap between the stator (the steel track) and the rotor (the door). Also, it allows for the easy installation and removal of the rotor from its frame. Most all doors and windows are installed/removed from their frames by lifting them up, so the bottom wheels may clear its guide rail/c-channel. In addition, it increases the insulating ability of the door or window by minimizing the air gap between the stator and rotor whilst still allowing easy installation/removal.

The perpendicular orientation of the permanent magnets to the ferromagnetic track is the most economical way to retrofit existing doors and windows to be magnetically suspended either partially or nearly wholly. This configuration allows the existing bottom wheels of conventional doors/windows to serve mostly as a guide track as opposed to supporting a load. This increases the service life of the door/window by greatly minimizing the wear and tear on the lower track (which is prone to warping over time), in addition to minimizing the load on the wheels (making them last longer).

Figure 5:
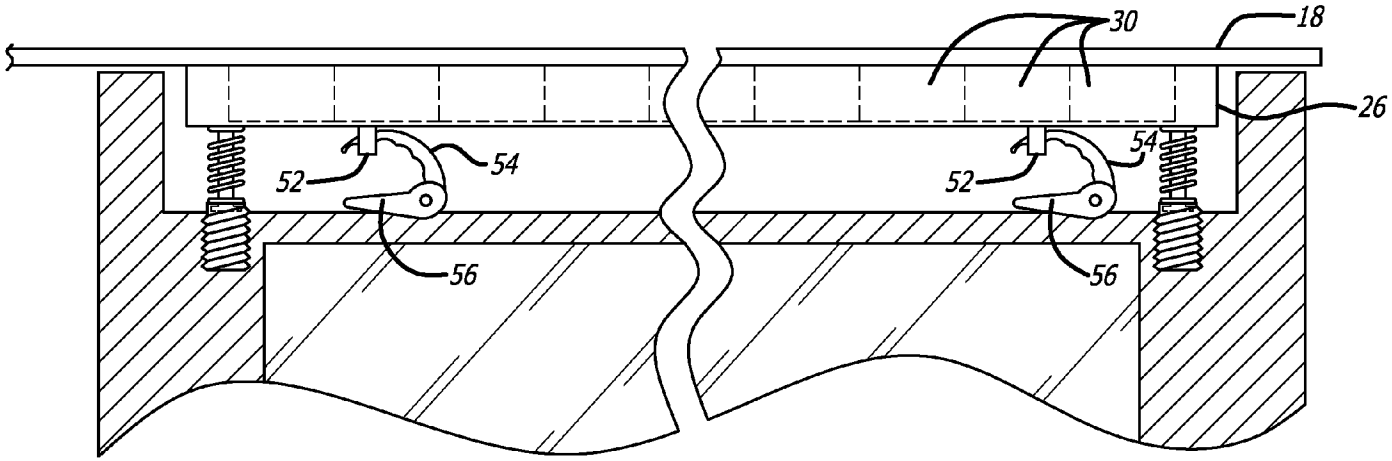
FIG. 5 is a cross sectional view of the present invention installed on a sliding object with a first locking mechanism.
Figure 6:
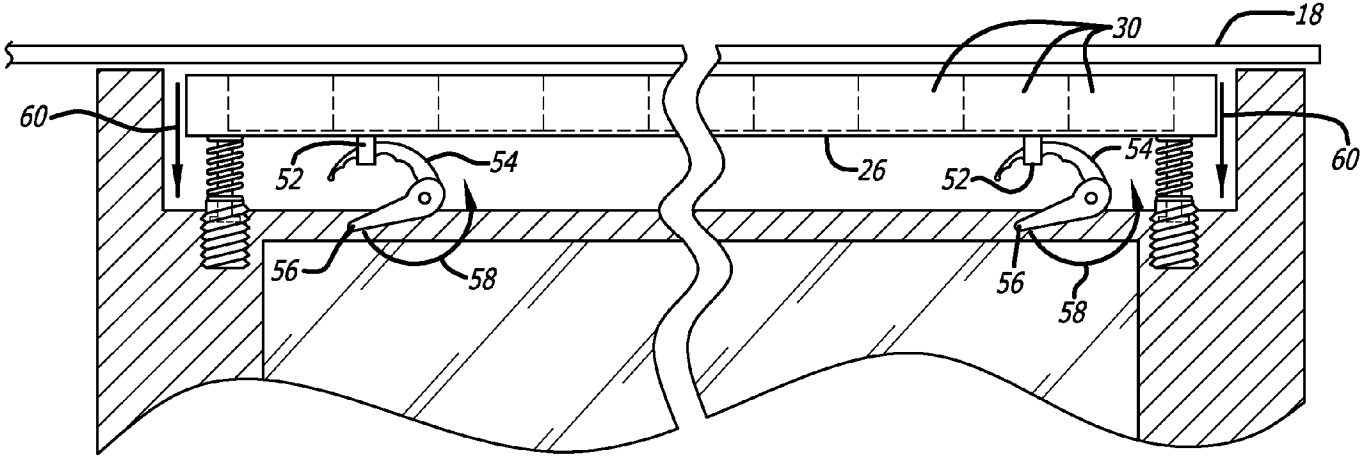
FIG. 6 is a cross sectional view of the present invention with the first locking mechanism rotating to the lock position.

FIGS. 5-8 illustrate mechanisms that allows the magnetic C-channel 26 to release from the steel strip on the frame, or connect the C-channel to the magnetic strip 18. It may be beneficial to engage the strip for insulation or for security reasons, and having an easy to use release makes operation of the system more user friendly. FIG. 5 shows the upper surface of the door 10 bearing against the magnetic strip 18 on the upper track 12. The C-channel 26 includes a pair of lugs 52 that are engaged by a pivoting arm 54 of a locking mechanism. The arm 54 is curved such that rotation of the arm 54, such as by control lever 56, in the direction of arrow 58 (see FIG. 6), drives the C-channel down in the direction of arrow 60 away from the magnetic strip 18 so that the two elements disengage. Rotation in the opposite direction to arrow 58 drives the C-channel upward so that the two elements will re-engage, thereby closing the gap between the door and the door from to prevent loss of heat or allow a thief to insert a tool or listening device.

Figure 7:
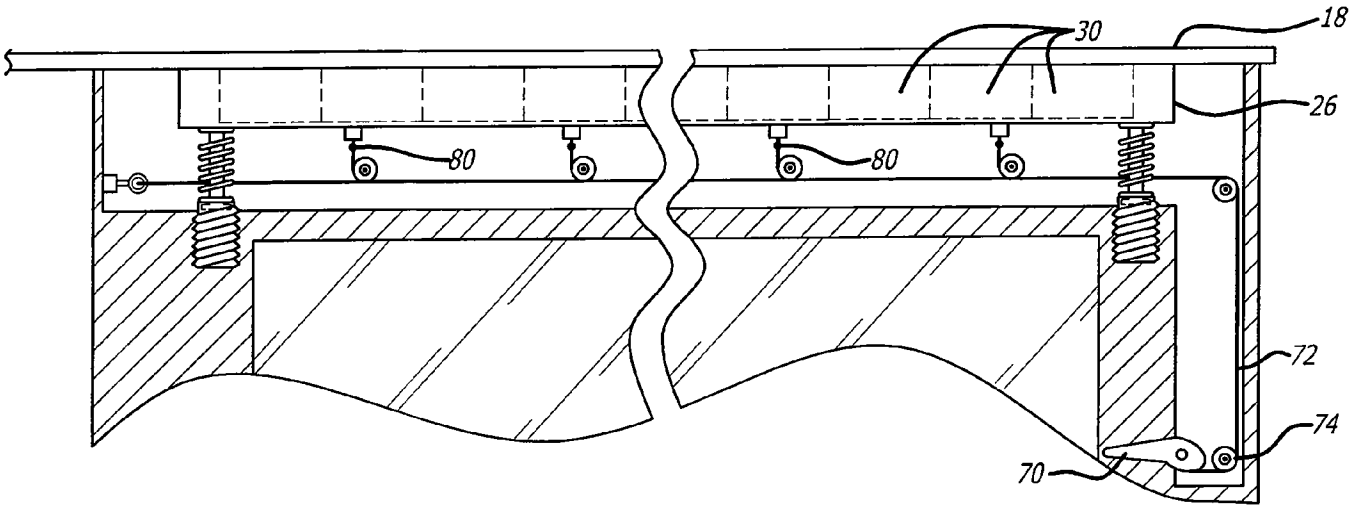
FIG. 7 is a cross sectional view of the present invention with a second locking mechanism.
Figure 8:
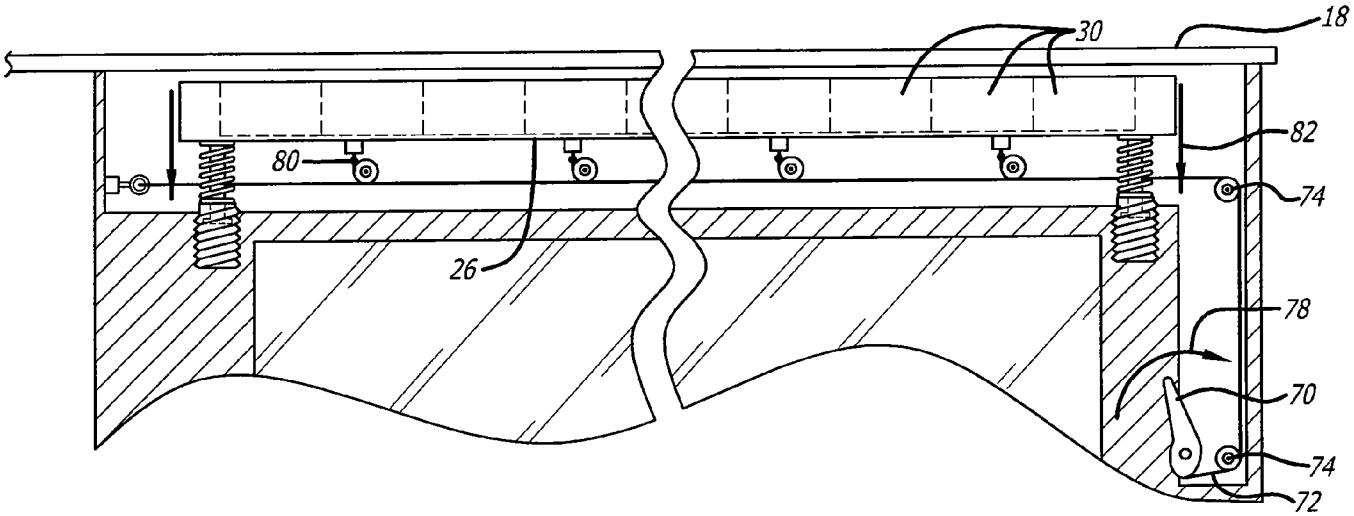
FIG. 8 is a cross sectional view of the present invention with the second locking mechanism rotating to the lock position.

FIG. 7 shows an alternative embodiment where a control lever 70 is coupled to a cable 72 mounted on pulleys 74. The control lever can also serve as the door lock mechanism, or it may be coupled to it or all together separate. The cable 72 is connected to points on the C-channel, such that when the control lever 70 is rotated in the direction of arrow 78, a force is applied to the connection points 80 to pull the C-channel away from the magnetic strip 18 in the direction of arrow 82, as shown in FIG. 8. When the control lever 70 is rotated in the opposite direction, the cable becomes slack and the C-channel can move closer to the magnetic strip as shown in FIG. 7, increasing the lifting force. This feature can also be used to prevent heat loss through the gap between the C-channel and the track 18, or for security purposes.

The present invention, in addition to being added relatively easily and inexpensively to adapt to current door and window manufacturing lines, also can be retrofitted to existing and installed doors/windows. Instead of the costly and time consuming task of replacing existing sliding doors and windows in an entire building; the present invention allows such doors and windows to be retrofitted to work as if they are brand new. The negative effects of warped window frames and rusted or worn out wheels are greatly minimized with this invention.

I claim:

1. A system comprising:

a panel retained in a track allowing substantially horizontal movement of the panel along a predetermined path, the panel having an upper surface with a longitudinal cavity therein;

a channel having a C-shaped profile is disposed within the longitudinal cavity of the panel, the channel holding a plurality of permanent magnets therein;

an elongate ferromagnetic plate disposed above the channel and parallel to, the the track of the panel;

a plurality of springs disposed in the cavity between the panel and the channel, the plurality of springs biasing the plurality of permanent magnets toward the ferromagnetic plate; and wherein the channel includes a plurality of lugs on a bottom surface thereof, a plurality of manually operated clamps each having a curved arm that passes through a respective one of said lugs to control a distance between the plurality of magnets and the ferromagnetic plate by releasably compressing said plurality of springs to move the channel within the cavity.

2. The system of claim 1, wherein each of said clamps includes a pivoting lever for pivoting a respective one of the curved arms about a pin.

* * * * *